United States Patent [19]

Lowi, Jr.

[11] 4,302,488

[45] Nov. 24, 1981

[54] CELLULOSE FIBER INSULATION PLANT AND PROCESS

[76] Inventor: Alvin Lowi, Jr., 2146 Toscanini Dr., San Pedro, Calif. 90732

[21] Appl. No.: 925,666

[22] Filed: Jul. 17, 1978

[51] Int. Cl.[3] ..... B05D 7/00

[52] U.S. Cl. ..... 427/212; 118/35; 118/37; 118/303; 118/667; 118/689; 427/372.2; 427/422; 427/424; 427/427; 427/8; 427/290

[58] Field of Search ..... 427/212, 422, 424, 427, 427/213, 372 R, 290, 372.2; 118/35, 37, 303, 345, 667, 689; 428/921

[56] References Cited

U.S. PATENT DOCUMENTS

| | | | |
|---|---|---|---|
| 2,269,563 | 1/1942 | Taylor et al. | 427/212 |
| 2,366,150 | 12/1944 | Yount | 118/667 |
| 2,623,496 | 12/1952 | Lowell | 118/689 |
| 3,198,655 | 8/1965 | Gisiger | 427/212 |
| 3,312,189 | 4/1967 | McVey | 118/689 |
| 3,960,735 | 6/1976 | Lacey | 428/921 |
| 4,034,126 | 7/1977 | Funakoshi et al. . | |

FOREIGN PATENT DOCUMENTS

| | | | |
|---|---|---|---|
| 573925 | 4/1959 | Canada | 427/212 |
| 613575 | 1/1961 | Canada | 118/689 |
| 1069363 | 5/1967 | United Kingdom | 427/212 |
| 469788 | 1/1974 | U.S.S.R. | 118/600 |

OTHER PUBLICATIONS

Anderson et al., "Survey of Cellulosic Insulation Materials" Energy Research Development Administration of Ind. Energy Conservation, D.C. pp. 1 and 15.

*Primary Examiner*—Michael R. Lusignan
*Assistant Examiner*—Janyce A. Bell
*Attorney, Agent, or Firm*—Nilsson, Robbins, Dalgarn, Berliner, Carson & Wurst

[57] ABSTRACT

A cellulose fiber insulation, a manufacturing method and a plant for practicing the method. Waste paper is pulverized in a hammermill apparatus to provide a quantity of cellulose fiber particles which are air conveyed past a fog-type injection nozzle where the particles are wetted with a solution of fire and/or pest resistant and corrosion inhibiting chemicals. The wetted particles are thereafter air conveyed away from the nozzle with heated exhaust air from the hammermill apparatus to dry the particles prior to depositing them in a storage bin. The air by which the particles are conveyed may be exhausted through a filter to catch residual particles which may be returned to the storage bin or directly to the process. The sprayed solution may be prepared by a batch process or by counterflow percolation of heated liquid upward through a bed of soluble fire-retardant chemical. The concentration of chemical in the resultant saturated solution may be regulated by a thermostatic control system. The weight ratio of solution to cellulose fiber may be controlled by sensing the flow rate of the cellulose fiber and generating signals to regulate the rate at which the solution is sprayed from the nozzle.

22 Claims, 8 Drawing Figures

CELLULOSE FIBER INSULATION PLANT AND PROCESS

BACKGROUND OF THE INVENTION

Figure 1A:
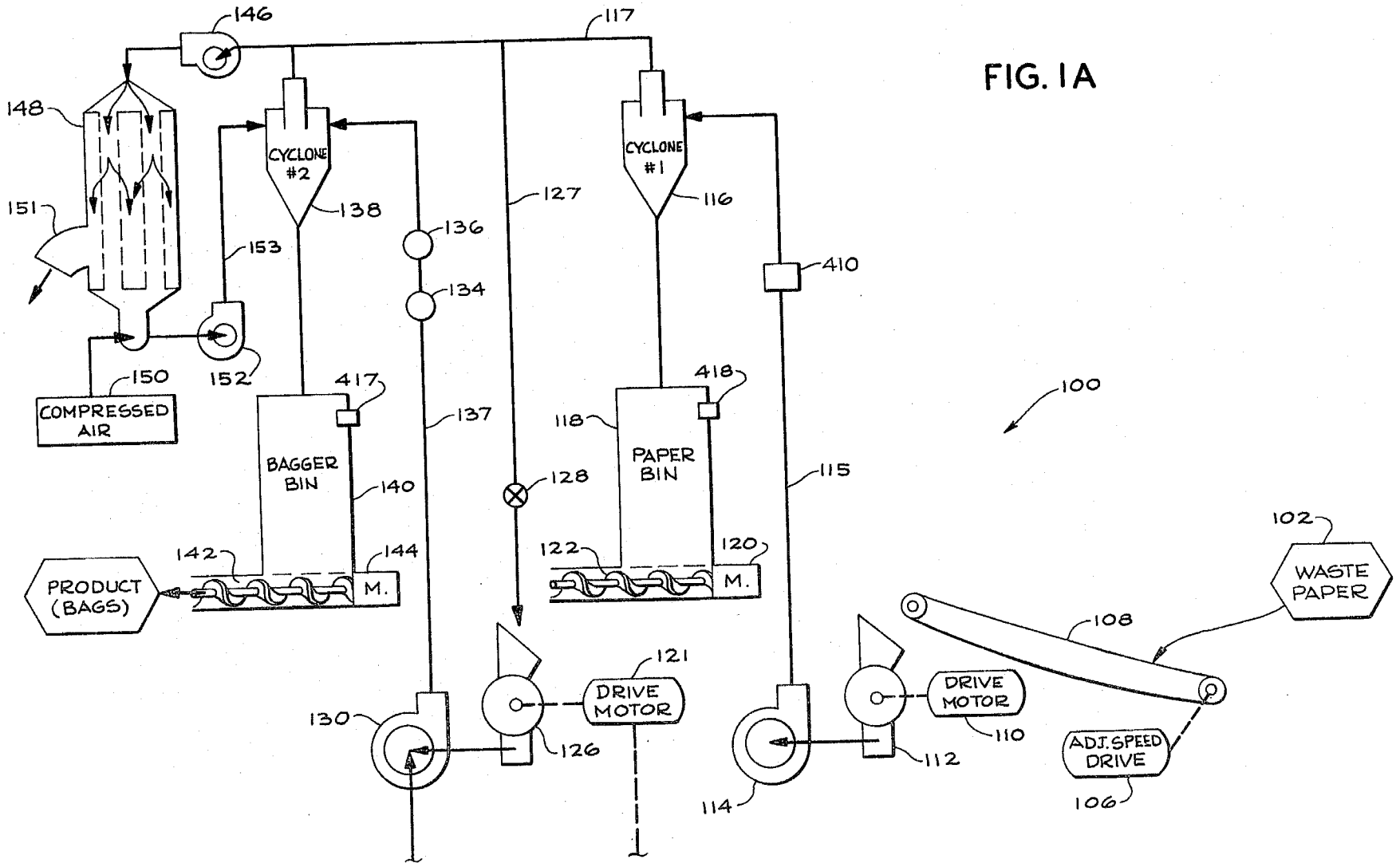

The present invention relates to methods and apparatus for producing an improved insulation and, more particularly, to a method and apparatus to impregnate cellulose fibers with a chemical solution to impart to the cellulose fiber fire and/or pest resistance.

Cellulose fiber thermal insulation generated from hammermilled newspaper has been used as a loose-fill insulation in buildings for more than thirty years. In order to reduce the fire hazard connected with this type material, various dry chemicals have been blended into the milled fibers, most notably, mixtures of powdered borax, such as sodium borate pentahydrate and boric acid. Fortuitously, these borates also give the finished material some measure of pest resistance. To obtain an acceptable flame spread resistance, this process requires a weight ratio of dry chemicals to cellulose fiber of about 1 to 3. Although various other dry chemicals have been utilized for imparting fire resistance, these chemicals usually require higher dose rates and introduce other problems, such as corrosiveness, toxicity, cost, microbial activity and adverse moisture absorption characteristics. A survey of the various chemicals and techniques utilized and representing the state of the art is given by R. W. Anderson of the U.S. Government's Energy Research and Development Administration in a paper entitled "Survey of Cellulose Insulation Materials," dated January 1977, and available through the National Technical Information Service (NTIS). A significant problem cited is the gross separation of the dense chemical particles from the fibers leaving the fibers unprotected, causing excessive dust and waste of chemical.

Until recently, the utilization of borates to chemically treat cellulose fiber materials to provide a thermal insulation has been adequate although wasteful. However, as the cost of domestic energy has burgeoned, the demand for all forms of thermal insulation has increased dramatically. With the advent of increased demand for cellulose fiber insulation, a proportionally increased demand for a supply of borate chemicals also appeared. However, the supply of borate chemicals was found to be somewhat inelastic and severe shortages of borates and, consequently, of properly treated cellulose fiber insulation came into existence accompanied by volatile prices and speculation with existing supplies. It has consequently become apparent that a substitute chemical, as well as a new process for manufacturing cellulose fiber insulation having permanently adequate fire retardant properties, is needed.

The textile industry has long known of the effectiveness of many chemical fire retardant agents which are utilized at much lower proportions to cellulose fiber content than has been practiced by the insulation industry utilizing borates. For example, one method of fireproofing textile fabrics has been to dip the material in a solution of specific concentration leaving a residual chemical intimate with and thoroughly absorbed in the fibers. Such dip and dry techniques are not practical in the cellulose fiber insulation industry because the cellulose fiber particles are very small, loose and not readily subject to such a dipping and drying process. Furthermore, it is not known which chemical agents offer the best combination of properties for both manufacturing and the finished product. Thus, even though the textile industry has fire-proofed textiles by the dipping and drying process, such a technique does not indicate how loose fiber may be impregnated with a wet chemical. Furthermore, the technical grade phosphates utilized in the textile industry are far too expensive for economic utilization in cellulose fiber insulation even at the lower residual treatment concentrations applied to the textiles.

It has been found that agricultural grade phosphates provide adequate fire-retardance, constitute a less expensive chemical than any of the various borates and may be utilized in substantially smaller ratios (see "Ammonium Polyphosphate Liquid Fertilizer As A Fire Retardant For Wood," American Wood-Preserver's Association, 1969, pages 1–12, by Eckner, Stinson and Jordan; and "Fire Suppression & Detection Systems," Glencoe Press 1974, by John L. Bryan.) However, such lower cost agricultural phosphates are difficult to pulverize and do not adapt to the dry blending process with reasonable yield or effectiveness. Furthermore, the more common of the agricultural phosphates (diammonium orthophosphate) has been found unstable in solution, in milling and at elevated temperatures, tending to evolve free ammonia which is an unacceptable nuisance in the manufacturing process. The use of agricultural grade phosphates in conventional wet blending processes can involve a high energy cost for a subsequent drying and is, therefore, impractial as well. The required tolerances within which variations in the proportion of the various constituents may vary cannot be practically achieved in continuous dry blending processes. Unacceptable variations in the proportions are further exacerbated by the fact that there is generally insufficient adhesion of the dry chemical to the fibers to prevent gross separation of the chemical and the cellulose fibers during bagging, shipping and application.

Utilizing the method and process of the invention disclosed herein, the full potential of cellulose fiber insulation may be realized. Not only can sufficient process control tolerances be achieved in practice, but a superior loose fill insulation, particularly applicable in the insulation of existing buildings, is obtained. Furthermore, the present invention generates a fire retardant cellulose fiber insulation which remains intact even in the presence of direct flame impingement and does not melt or contribute to fuel the fire. Because the present invention utilizes a wet impregnation and drying process, the fire retardant impregnation is complete and uniform assuring a uniformity of properties with no material separation. In addition, resistance to vermin and microorganisms is easily obtained by simply mixing into the solution traces of appropriate chemical or biocidal agents with the fire retardant chemical prior to impingement on the cellulose fibers. Corrosion protection can likewise be obtained with the addition of appropriate chemical inhibitors.

The raw materials, including the phosphates and the cellulose fibers, are low cost and widely available in large quantities. Furthermore, the cellulose fibers may be obtained from recycled newsprint and other waste materials which make optimal use, and thus conservation, of natural resources. In addition, the agricultural grade phosphates utilized in the present invention are among the most plentiful bulk chemicals available and, unlike borates, can amount to but a negligible fraction of the total use of such chemicals for agricultural purposes. Another advantage of the method and apparatus in accordance with the present invention is that the materials used are physically and chemically benign achieving the maximum of occupational safety and environmental protection in both the manufacturing and installation process. Furthermore, the finished product has a low content of very fine particles and, thus, a much reduced tendency to make dust. Finally, a principal advantage of the present invention is that the manufacturing plant involvement, know-how, energy and operating costs are less than for other types of insulation processes and the installation skills and equipment required are minimal and well known.

SUMMARY OF THE INVENTION

The present invention comprises a cellulose material treatment system which initially incorporates a pulverizing apparatus for pulverizing cellulose material into a quantity of cellulose fiber. A means for formulating a composite solution of at least one protective chemical agent is provided. A means for uniformly wetting the cellulose fiber with the solution is provided and includes a means for separating the cellulose fibers into individual particles and a means for spraying a mist of the composite solution into the individual particles. A means for drying and then collecting the individual particles to form a quantity of treated cellulose fibers is finally provided.

More particularly, a shredder or hammermill or other similar device initially breaks the cellulose material into relatively coarse particles. The resultant material may then be sorted to take out any metallic materials or heavy particles which may be contained therein. The resultant cellulose material is next air conveyed along ducting by means of a fan positioned to generate a flow of air through the ducting, to a cyclone separator which separates the cellulose material from the flowing air and deposits the cellulose material in a bin. The exhaust air may then be exhausted through a filter to remove fine fibers and dust. The coarse cellulose particles in the paper bin are metered by an adjustable speed screw feeder to a second hammermill for milling the material into fibers, preferably small enough to pass through a 10/64 to 16/64 inch screen. A portion of the exhaust air from the first cyclone separator, which has been heated in the hammermill process, is recycled to the inlet of the second hammermill to aid in the subsequent drying process step. Of course, it will be appreciated that any means for pulverizing the cellulose material to obtain quantities of cellulose fibers having a relatively small size can be utilized in accordance with the present invention.

At the output of the second hammermill, a fan is provided to again air convey the cellulose fibers along a flow path defined by additional ducting to a second cyclone separator. Incorporated as part of the fan at the output of the second hammermill is an injection nozzle to generate fine droplets of a fire retardant chemical solution. This solution is sprayed from the injection nozzle into the small cellulose fibers from the second hammermill as the cellulose fibers are blown past the nozzle so that the fine droplets are intimately contacted with the cellulose fibers and are absorbed therein. Subsequently, most of the moisture is extracted from the fibers by the hot dry air generated by the pulverizing process and utilized in the air conveyance of the fibers. The air is utilized to convey the particles to the second cyclone separator and preferably has a temperature sufficient to produce substantially dry impregnated fibers in a second cyclone separator. The second cyclone separator separates the impregnated cellulose fibers and deposits those fibers in a second bin from which the finished product may be withdrawn and bagged. The exhaust air from the second cyclone separator may also be exhausted through the filter which recovers the small cellulose fibers remaining and exhausts the filtered air and water vapor. The resultant fibers collected in the filter may be returned to the second collection bin utilizing additional ducting and fans.

The chemical solution sprayed by the injection nozzle may be prepared by a batch process or by counterflow percolation of heated liquid upward through a fixed bed of soluble chemical, such as ammonium phosphate. Using the percolation method, the concentration may be regulated by the simple method of thermostatic control of the resultant saturated solution since the concentration of the chemical in such a saturated solution is almost strictly a function of temperature.

In addition to controlling the concentration of chemical in the solution, the amount of such solution which is combined with the cellulose fiber in order to achieve the desired chemical to cellulose ratio may be achieved by slaving a chemical solution pump to the second hammermill in the following manner.

Recognizing first that the current provided to the drive motor of the second hammermill is related to the mass flow rate of cellulose fiber processed by the mill, the current transformer of an adjustable current relay installed in the drive motor line of the second hammermill may be utilized to generate a signal which is proportional to the mass flow rate of the cellulose fiber. This signal may then be utilized to control an adjustable speed drive mechanism equipped with an external signal follower feature. Once the desired ratio between chemical solution and cellulose fiber is defined, the adjustable speed drive may be appropriately calibrated to adjust the pumping rate of the injection pump which draws the saturated solution from a settling tank and forces the solution through the injection nozzle. Thus, once the desired ratio between the chemical solution and paper is set, the adjustable speed drive in conjunction with the adjustable current relay acts to adjust the speed of the injection pump to follow the current level of the second hammermill motor thereby maintaining a ratio between chemical and cellulose fiber within a narrow tolerance over a wide range of cellulose fiber flow rates. This method may also be applied to a process in which only one hammermill is used in a single storage milling operation.

The preferred embodiment of the present invention thus provides control apparatus whereby a constant concentration of chemicals in a solution and a constant ratio between the amount of chemical and cellulose fiber in a finished product may be maintained within narrow tolerances. It is also obvious that, when a screw feeder is used to meter pre-grooved paper to the finish mill, feed speed can be used to provide the proportional control of the injection pump.

Finally, apparatus may be provided in the present invention to combine auxilliary fire retardant or pest retardant chemicals with the saturated solution just prior to its being sprayed through the injection nozzle. Of course, to obtain the proper chemical solution in a batch process, the auxiliary chemicals may be added directly to each batch as it is formulated.

TABLE-continued

Pancreatic juice secretion of the rat after subcutan. administration of 5 CU/kg of secretin with different depot bodies (10 mg/animal)

| 1 Depot body | 2 Preparation | 3 Δ% vs. control | 4 Rel. Intensity of effect over 5 hours |
|---|---|---|---|
| diaminoethane | | | |
| Bis-(2,4-dihydroxybenzoyl-L-tyrosine)-diaminoethane | C | 82 | 6.0 |
| Bis-(3-benzoylpropionyl-L-tyrosine)-diaminoethane | C | 60 | 3.7 |
| Benzyloxycarbonyl-L-tyrosyl-L-tyrosine | L | 62 | 7.5 |
| Nα,Nε-Bis-(benzyloxycarbonyl-L-tyrosyl)-L-lysine | C | 48 | 7.0 |
| Nα,Nε-Bis-(benzyloxycarbonyl-L-tyrosyl)-D-lysine | C | 13 | 1.5 |
| Nα,Nε-Bis-(benzyloxycarbonyl-L-tyrosyl)-L-lysine-methyl ester | C | 93 | 8.2 |
| Nα,Nε-Bis-(benzyloxycarbonyl-L-tyrosyl)-L-lysine-amide | C | 90 | 8.4 |

As may be seen from the Tables, all phenolic depot bodies tested have a protracting and intensifying influence on the secretin.

The depot bodies which may be employed according to the invention are either compounds known from the literature or those which are prepared, for example, in accordance with the methods described in the experimental part. It is a great advantage that even low molecular weight compounds of simple structure which may easily be obtained are suitable depot bodies.

The fact that these phenolic depot bodies are not only present in admixture with secretin, but also form addition products with the latter, may easily be seen from the drastic reduction of the molecular extinction of the phenols in the proximity of 280 nm by up to 50%, while adding increasing amounts of secretin.

However, since the said adduct formation is reversible and subject to the law of mass action, it is advantageous to use a large molar excess of depot bodies. For subcutaneous administration in humans, from 10 to 100 mg of a depot body in 1 to 2 ml of solution or suspension are used per 80 to 1000 clinical units (CU; 1 mg of secretin=4000 CU; according to Gut 19 (1978, page 355), 1 mg of secretin is reported to have a biological effect corresponding to 5000 CU). If a gelatin derivative is added to improve the effect, its concentration is from 30 to 100 mg/ml. Also the gelatin derivatives optionally present in the secretin reduce the UV extinction of the phenols and are thus present in a complex bond. For preparing the adducts and mixtures it is sufficient to bring the components into contact with one another for a short time in a solution. The adduct formation takes place rapidly.

As phenolic depot bodies for the rectally administrable secretin preparations, those specified in the Table may also be used.

It is a great advantage also for this type of preparation that already even low molecular weight compounds of simple structure which are easily accessible are suitable to increase the available amount of secretin from suppositories or rectal capsules in a way that a rectal administration of secretin becomes possible or useful for the first time. The reversible adduct formation mentioned before also takes place, and it is equally advantageous to use a large molar excess of depot bodies.

The intensified effect of secretin in the form of rectally administrable preparations due to the depot bodies used according to the invention becomes evident from the drawing. In a test carried out on 8 rats each weighing 0.5 kg, 100 μg of secretin in a suppository of a weight of 73 mg cause the production of 92 μl of pancreatic juice (curve 1). With the addition of 25 mg of 3,5-dihydroxybenzoyl-L-tyrosine the volume of pancreatic juice rose to 1778 μl (curve 2). This corresponds to an increase of the effect to about 20 times its original value. Besides, a protracted action can also be observed. In the present case the secretin dose has been chosen very high in order to obtain a measurable volume also without additive.

With a non-maximum stimulation in the normal dose range (about half the dose), the increase of the effect is about 50-fold.

For the treatment of humans, from about 0.1 to 2 mg of secretin are required per suppository (=400 to 8000 clinical units CU; 1 mg of secretin=4000 CU; according to Gut 19 (1978), page 355, 1 mg of secretin is stated to have a biological effect corresponding to 5000 CU). The minimum amount of depot bodies is about 50 mg. The maximum amount is determined by the processibility. For a suppository of a weight of about 2 g it is up to 1 to 1.5 g.

Another subject of the invention is a process for the manufacture of a secretin preparation having a protracted and intensified action.

A subcutaneously administrable preparation of the invention is preferably obtained by dissolving secretin hydrochloride prepared according to U.S. Pat. No. 4,098,779 (corresponding to German Offenlegungsschrift No. 2,615,229) in water or in the aqueous solution of one of the above-specified gelatin derivatives and combining the resulting solution with the solution of the depot body in water. In this process the pH value is in the range of from 7 to 8.5. It is adjusted to 7.0 to 7.8 with a physiologically acceptable acid, whereupon the solution is lyophilized.

Some depot bodies are sparingly soluble and are present under the above conditions in a suspension. In this case an amorphous or crystalline suspension is prepared by precipitation of the phenols dissolved at pH 10 and adjustment of the pH to the range between 7.0 and 7.4, which suspension may be stabilized by the presence of a gelatin derivative as defined above. This suspension is combined with the aqueous solution of secretin, or lyophilized secretin is dissolved in this aqueous suspension. Already after a short time the secretin is fully adsorbed on the depot body. This secretin-containing suspension should be injected within one week.

Furthermore, it is also possible to dissolve the phenolic depot bodies in water containing up to 30% of a solubilizer. Suitable solubilizers are 1,2-propylene glycol, 1,3-butylene glycol, polyethylene glycol, tetrahydrofurfuryl alcohol-polyethylene glycol ether, dimethyl sulfoxide, N-methyl pyrrolidone or dimethyl formamide. In this case the solution of the depot carrier is preferably prepared without secretin, and said solution which is not lyophilized is filled into ampules of preferably 1 to 2 ml. In a second ampule the secretin is present in a lyophilized state. Immediately prior to application the secretin is dissolved in the solution of the depot carrier, whereupon the adduct is formed. A gelatin derivative may optionally be added to the secretin or the depot body or both.

The process for the manufacture of rectally administrable secretin preparations with protracted and intensified action comprises preparing suppositories or rectal capsules from a mixture of a generally common carrier, secretin and a phenolic depot body as characterized above.

As suppository mass, known compounds, for example partial glycerides, i.e. mixtures of mono- and diesters of glycerol with higher fatty acids, furthermore fatty acid-1,2-propylene-glycol esters, and moreover polyethylene glycols with a solidification range of from about 30° to 50° C. are used. The secretin incorporated into masses of this kind or into oil, together with the phenols to be used according to the invention, may also be filled into commercial rectal capsules.

The suppositories are manufactured by homogenizing the mixture of carrier, secretin and a phenol to be used according to the invention in the melt and subsequently filling it into suppository molds, while still in the liquid state, in which molds said mixture is allowed to solidify. Semisolid or oily suspensions are filled into rectal capsules. The weight of a suppository is from about 1 to 3 g.

In a similar manner it is also possible to manufacture suppositories comprising glycerol and gelatin.

Suppository masses such as fatty acid-1,2-propylene glycol ester are mixed together with secretin and a depot body to be used according to the invention and molded into granules without melting. The suppositories or rectal capsules of the invention are used for treating and preventing hemorrhages of the intestinal tract and for the treatment of ulcers. They represent the first secretin preparation not to be administered by injection.

The invention relates further to the phenolic compounds specified in the Table which have not yet been described in literature, which may be prepared according to the processes indicated above and are used as depot bodies for the secretin preparations of the invention. A special subject of this invention is 3,5-dihydroxybenzoyl-L-tyrosine.

Phenolic depot bodies with carbonamide groups are synthesized according to common methods for the preparation of carbonamide compounds, if they have not been known from literature.

Particularly suitable and easily accessible depot bodies, as they are specified in the Table, may be prepared, for example, from hydroxyl group-carrying carboxylic acids and amines. Amine components may also be amines optionally carrying hydroxyl groups, amino acid esters, peptide esters or amino acid- or peptide amides. If the amine components contain carboxylic acid groups, the latter are advantageously prepared from the corresponding esters, in most cases methyl esters, by saponification. By the action of ammonia or amines on these esters amides are formed. Further functional groups have to be blocked temporarily, if necessary, by protective groups such as are common in peptide chemistry.

Furthermore, the phenolic OH groups may also be protected, for example, by acetylation, during the amide synthesis. The protective groups are split off from the reaction product in known manner by a treatment with alkali, ammonia or amines. It is also possible, however, to prepare the amide bond without previous protection of the OH groups if the condensation is carried out by way of carbodiimide in the presence of an additive such as 1-hydroxybenzotriazole (Chem. Ber. 103, (1970) pages 788 to 798).

2-Carboxy-carbonamide groups are prepared from the inner anhydrides.

The phenolic depot bodies to be used in accordance with the invention may be present in part as salts, for example alkali metal or alkaline earth metal salts, or as salts with organic bases, for example trishydroxymethylaminomethane. These salts are obtained, for example, by dissolving or suspending the corresponding phenolic compound in water and adding a base, while stirring, until a pH of from 7.0 to 7.5 is reached and maintained.

The secretin preparations of the invention are used for treating and preventing hemorrhages of the intestinal tract and for the treatment of ulcers, said preparations being administered by injection or rectally.

In the following Examples, general directions which are easy to carry out have been indicated for preparing the depot bodies and depot preparations, however, without restricting the invention.

EXAMPLE 1

Components such as alkylamine, esters, tert. amine or alkylamide mentioned in this Example contain up to 8 carbon atoms.

A. 1 Mol of an acetoxy-benzoic acid is boiled in 5 times the amount (g/v) of thionyl chloride for a period of from 30 minutes to 1 hour. The excess thionyl chloride is distilled off, then the batch is redistilled with toluene, and the residue is dissolved in toluene, tetrahydrofuran, dimethyl acetamide or other substances and combined with 2 moles of amine component (alkylamine, dialkylamine, morpholine, tyrosine ester or tyrosine alkylamide, lysine ester or lysine alkylamide, aminoalkyl-phosphonic acid, aminoalkyl-dialkyl-phosphine oxide, aminobenzene sulfonamide and others) or with 1 mol of amine component and 1 mol of a tertiary amine, whereupon the mixture is allowed to react for 1 to 2 hours at room temperature, with stirring. For work-up, the reaction mixture is poured into water, the precipitate is filtered off and purified by recrystallization from methanol or other substances. If the compound is too easily soluble in water, the solvent is distilled off, and the residue is digested with a small amount of water or ethanol. The product is purified by recrystallization from isopropanol, ethyl acetate, or similar substances.

In order to split the acetoxy groups and esters, if any, the product is saponified with 1.5 mols of 2 N NaOH per cleavable group in methanol or methanol/dioxan/-water (about 3:3:1). It is neutralized after about 1 hour with HCl, the solvent is distilled off, thereafter the product is taken up (optionally suspension) in water and acidified with HCl. The precipitate is filtered off and washed with water. In the case of easily water-soluble compounds, the solution of the compounds is diluted directly following the saponification with methanol/-water (1:1), filtered via a strongly acid ion exchanger and evaporated to dryness. The residue is recrystallized from a suitable solvent such as isopropanol, ethyl acetate, or similar substances.

B. 1 Mol of a hydroxy-benzoic acid and 1 mol of an amine component according to Example 1 A are dissolved in dimethyl formamide. There are added 1 mol of 1-hydroxy-benzotriazole and 1 mol of dicyclohexyl carbodiimide, after 4 hours the solution is filtered off from the precipitated dicyclohexyl urea, An auxiliary chemical solution feeder apparatus may also be provided and is particularly useful if the percolation method of obtaining a saturated solution is used. In a preferred embodiment, the auxiliary chemical solution feeder comprises an adjustable speed drive motor 212 coupled to operate a chemical solution feeder pump 210. The pump 210 is interposed in a flow path 211 along which auxiliary chemicals 208, held in an auxiliary chemical tank 206, are pumped. The flow path 211 is then coupled to the flow path 201 to thereby cause the auxiliary chemicals to be mixed with the fire retardant chemical solution, the mixture being inserted into and sprayed from the injection nozzle apparatus 132. The pumping rate of the pump 210 may be slaved to the rate of the drive motor 121 in a manner similar to that described in conjunction with the positive displacement injector pump 192. Thus, the signal follower means 149 may be used to provide a signal to the pump 210 to define the rate at which the pump 210 operates and thus the flow rate of the chemicals along the path 211.

The chemical solution flowing in the flow path 189 may be prepared by counterflow percolation of heated liquid upward through a fixed bed of soluble solid fire retardant chemical, such as raw phosphate prill. Such a process produces a supernatant consisting of a saturated solution at a fixed temperature. More particularly, a tank 171 is provided into which dry chemicals 154 may be placed. The resultant mass of chemicals forms a soluble bed 166 surrounding a perforated pipe 168 so that a chemical solution flowing along a pipe 159 is caused to pass through the perforations in the pipe 168 and percolate up through the soluble chemical bed 166 to form a saturated solution of the chemical 164.

The saturated solution 164 is drawn off through the baffles 174 into a pipe 179. A circulating pump 178 is provided to draw the saturated solution 164 from the tank 171 and cause it to pass through a heater 180 and into a pipe 181. A thermostat 182 is incorporated in the pipe 181 to monitor the temperature of the solution coming from the heater 180 and provide a signal to turn the heater off if the solution in the path 181 is too hot and on if the solution is too cool. By using thermostatic control, a saturated solution at a fixed temperature is provided with the concentration of chemical in solution defined since the concentration is a function of temperature.

A portion of the solution flowing along the path 181 is recirculated back into the tank 171. As the solution is decanted off and consumed in the process, tap water 156 is added to the tank 171, for example, by adding water to the pipe 179 to dilute the saturated solution flowing along the pipe 179 into the heater 180. A float switch 160 is provided in the tank 171 to sense the level of saturated solution and provide a signal to a solenoid valve 158 to allow tap water to be mixed into the saturated solution if the level of the tank falls below a certain value. Thus, the float switch 160 and the solenoid valve 158 combine to provide a means whereby the level of solution in the tank 171 is maintained.

The residue or sludge 170 which results from the process is collected in the bottom of the tank 171 and may be periodically drained through a drain by opening a valve 172.

In operation, a portion of the chemical solution flowing along the path 181 is bled off and passed along the pipe 165 to a settling feed tank apparatus 184 which comprises a basket strainer 188, a baffle 186 and a line strainer 187. The saturated solution circulates through the basket strainer 188 and baffle 186 and is drawn out by the pump 192. Any excess solution input to the tank 184 is caused to return to the holding tank 171 through an overflow drain 185. The settling tank 184 may also be provided with a downward sloping surface in the bottom of which is a drain valve 190 to allow the residue collected to be periodically drained off.

Figure 3:
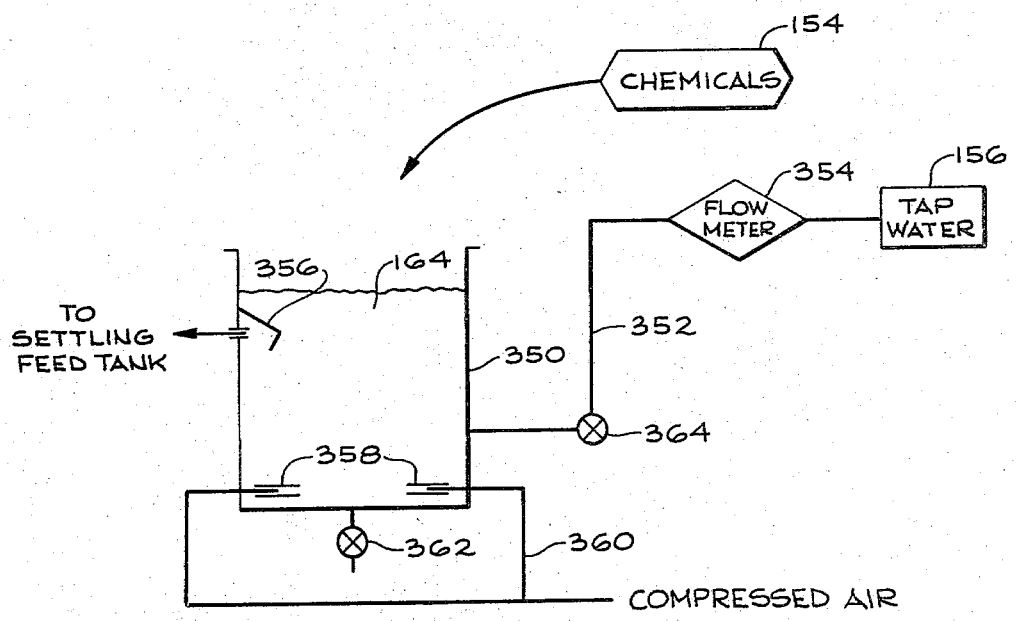

The proper concentration of chemical solution may also be obtained in a batch process. Thus, referring to FIG. 3, a specific quantity of chemicals 154 is placed in a mix tank 350. A set quantity of tap water 156 is added to the mix tank 350 along the pipe 352. A flow meter 354 may be placed in the pipe 352 to measure the quantity of water which has been input to the mix tank 350 so that a valve 364 may be turned off when sufficient water has been added. In order to obtain the chemicals in solution, compressed air is caused to flow along the pipes 360 and through the sparging venturies 358 to thereby cause turbulance in the mix tank to facilitate the solution of the chemicals in the water. Once the desired solution is obtained, the solution 164 may be drawn off through the baffle 356. A heater and thermostatic control (not shown) as previously described may also be utilized in this embodiment, as may the settling feed tank 184. A drain 362 is also provided in the mix tank 350 to allow sludge and other deposits to be drained periodically from the tank 350.

Figure 4A:
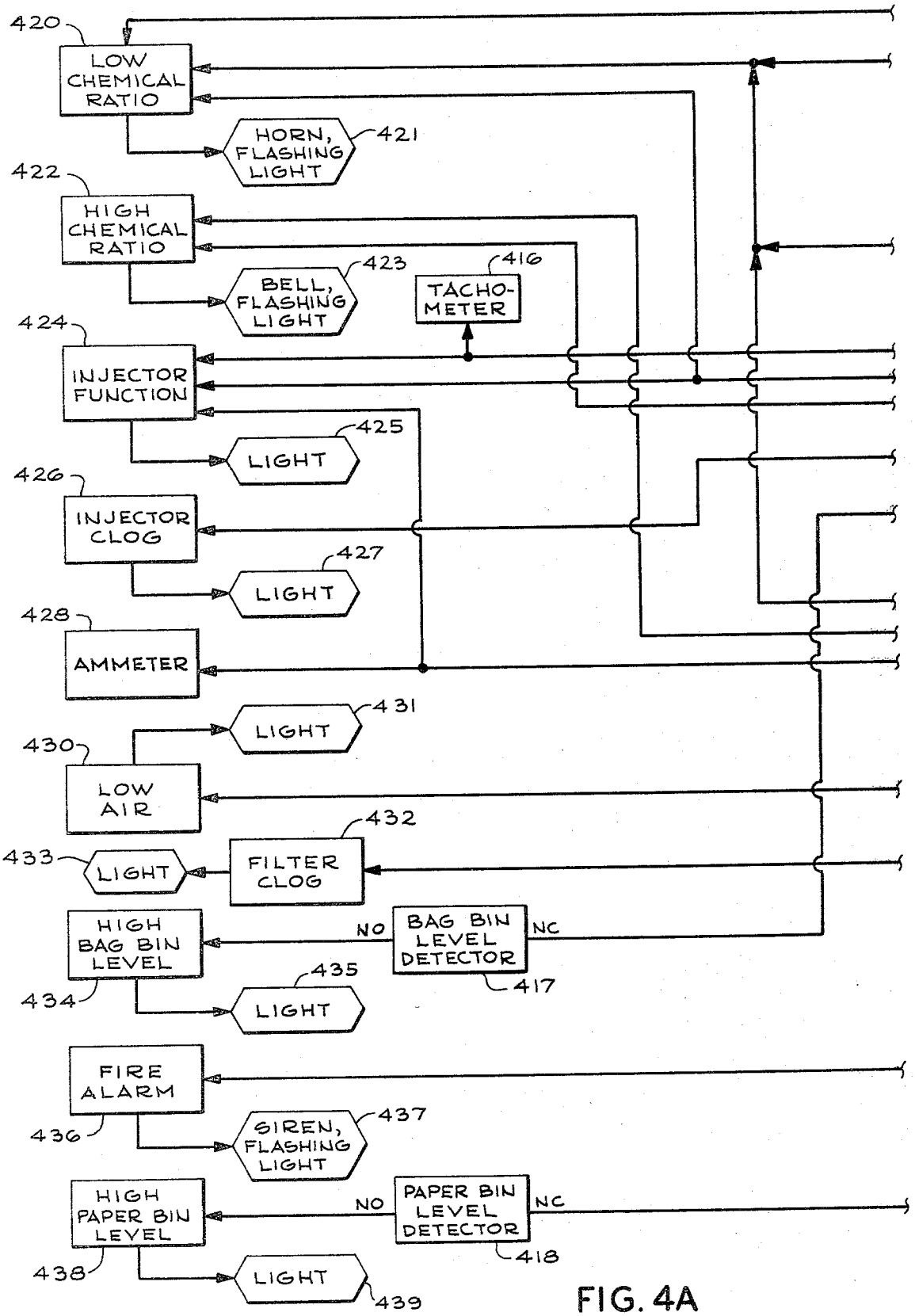
Figure 4B:
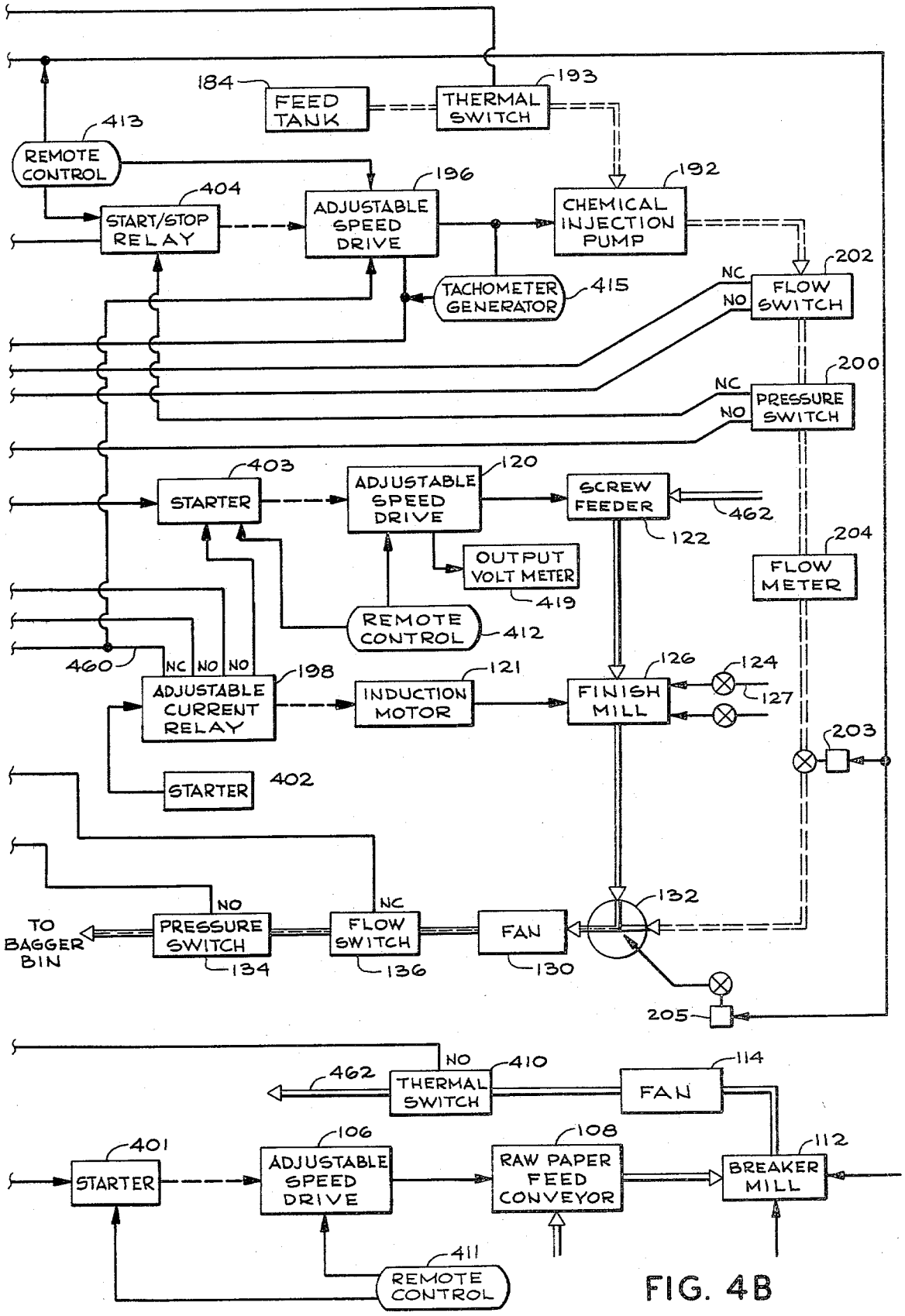

A block diagram of the arrangement of various controls and alarms which may be utilized in conjunction with the present invention is given in FIG. 4. The system may employ a combination of analog and binary signals to monitor and control automatic operations with manual overrides provided for all functions.

Figure 1B:
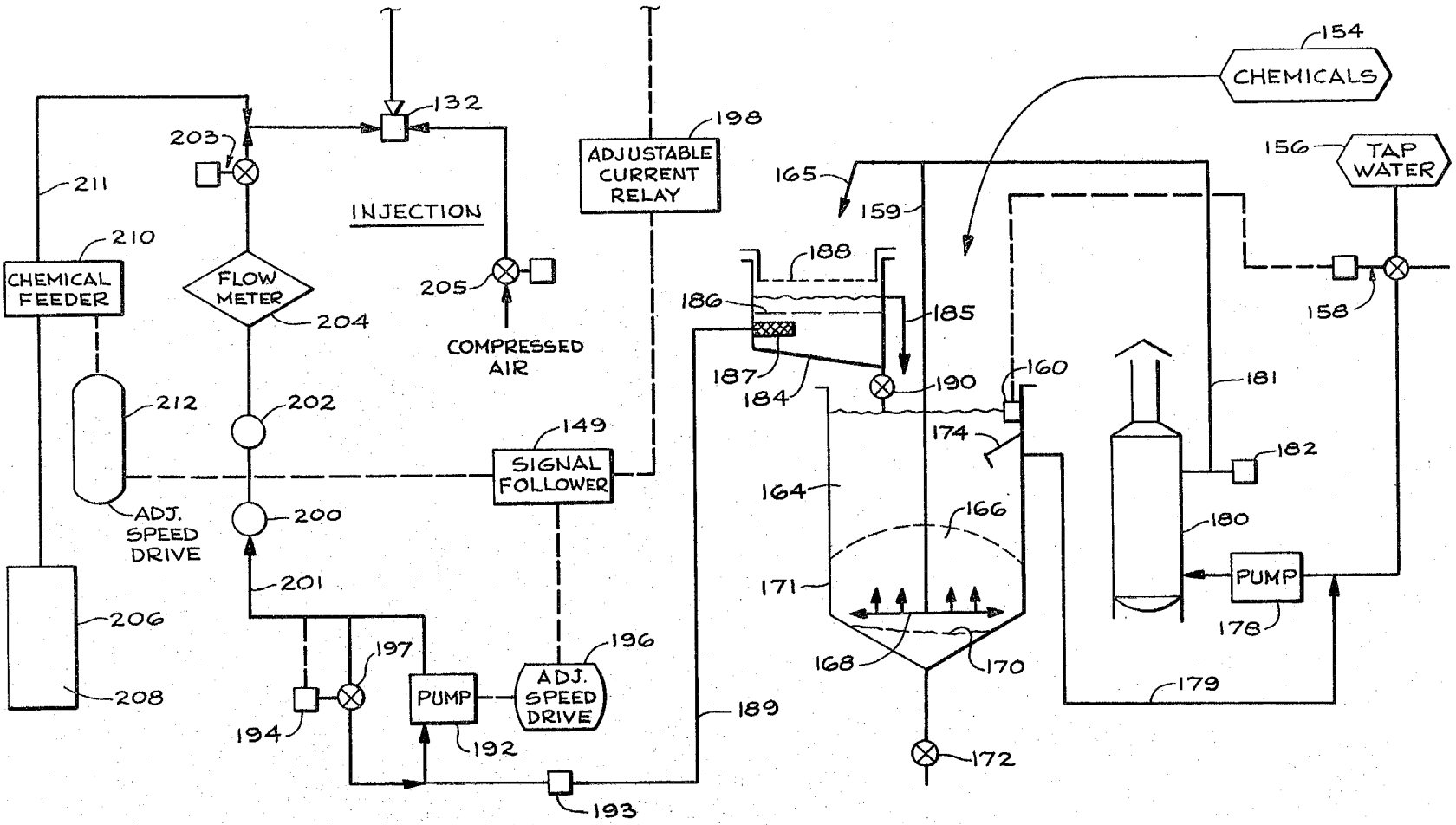
Figure 2:
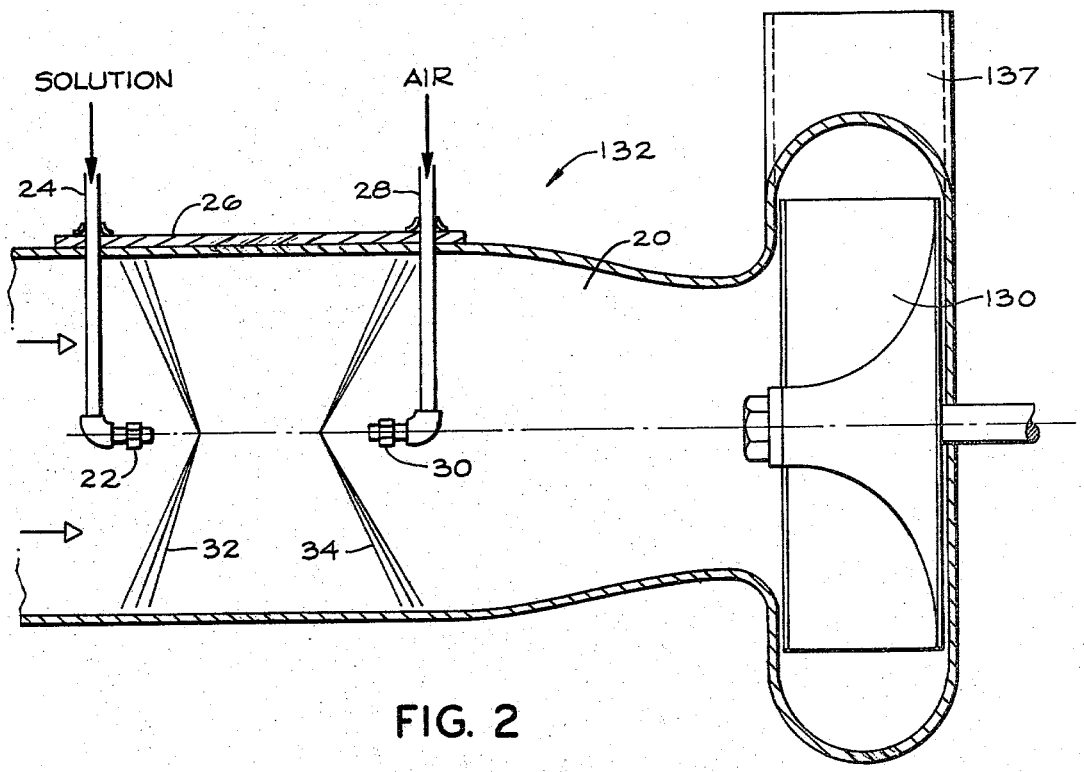

Specifically, a low chemical ratio control or indicator 420 is provided to monitor the ratio of chemical to paper being produced. Coupled to the low chemical ratio indicator 420 is the normally closed (NC) contact of the solution flow switch 202 which indicates subnormal chemical flow, the normally opened (NO) contact of a solution thermal switch 193 which is placed in the flow path 189 (FIG. 1B) and indicated subnormal temperature of the chemical solution, and the normally opened contact of the adjustable current relay 198 which indicates sufficient paper flow. If any of the above contacts in the normally opened or normally closed terminals of the switch are closed, then the low chemical ratio indicator 420 sends a signal to a horn and light 421 thereby energizing the flashing light and horn which indicates that insufficient chemical is being mixed with the cellulose fiber particles. Normally, the adjustable current relay 198 provides an analog signal to the adjustable speed drive 196 of the injection pump 192 on a lead 460 to control the operation of the chemical injection system including the pump drive and the solenoid valves. Thus, the low chemical ratio indicator 420 indicates the abnormal situation where proper solution flow is called for, but either insufficient flow volume or concentration fails to develop and a product deficient in chemical content is being produced. Such a situation calls for remedial action by an operator.

Corresponding to the low chemical ratio indicator 420 is the high chemical ratio 422. Coupled to the high chemical ratio indicator 422 is the normally closed contact of the adjustable current relay 198 which indicates a low paper flow when it is opened and the normally opened contact of the solution flow switch 202 which indicates a normal operating level of solution flow when it is closed. If both of these contacts are actually closed and conducting, then the high chemical ratio indicator 422 activates a bell and flashing light 423 which indicates that the ratio of chemical to paper being produced is too high.

In operation, such a situation will generally not occur because the adjustable current relay 198 will normally have generated an analog signal of a magnitude which would have shut down the adjustable speed drive 196 of the chemical injection pump 192, thereby avoiding overdosing the product with chemical and water and preventing excessive build-ups of these constituents in the ducting. If a high chemical ratio indication is given, however, operator attention is required.

A third indicator is the injector function 424 which receives a tachometer generator signal from a tachometer generator 415, indicating the rotation speed of the chemical injection pump; the analog signal from the adjustable current relay 198 along the lead 460 indicating the flow rate of the paper; and the output from the normally closed terminal of the flow switch 202, which indicates insufficient chemical flow. If either the rotational speed of the chemical injection 192 or the paper flow rate is sensed by the adjustable current relay as normal and the normally closed contact of the flow switch 202 is conducting indicating insufficient current flow, then the injector function 424 generates a signal to a light 425 indicating an injection system failure requiring operator action.

A fourth indicator is the injector clog indicator 426, which is coupled to the normally opened contact of the pressure switch 200 in the chemical flow path. If the normally opened contact of the pressure switch 200 is conducting, indicating an excessive injection pressure, then a warning light 427 is activated by the injector clog indicator 426 because of a probable blockage of the nozzle 132. Under this situation, it is preferable that the normally closed contact of the pressure switch 200, which will be non-conducting, be coupled to a start/-stop relay 404 to shut down the adjustable speed drive 196 and, consequently, the chemical injection pump 492, to prevent excessive wear or damage to the pump 192.

A fifth control is provided by the ammeter 428 which is coupled to the analog signal on the lead 460 from the adjustable current relay 198 of the finish hammermill 126. The resultant analog signal is displayed on the ammeter 428 to visually indicate the level of paper flow as well as the mill load. Such an indicator provides the operator with the information needed to regulate the paper feed rate with remote control of the adjustable speed drive of the screw feeder 122.

To facilitate this function, the adjustable speed drive 120 of the screw feeder 122 is provided with an output volt meter 419 to indicate the drive speed selected. The mill load is controlled by manual adjustment of this speed from the remote control 412. An additional normally opened contact in the adjustable current relay 198 is coupled to a starter 403 to turn on or off the adjustable speed drive 120 and, thereby, interrupt the screw feeder is abornally high loads occur. Such a turn off control is automatic.

A sixth indicator which may be provided is a tachometer 416 coupled to the tachometer signal from the tachometer generator 415. The tachometer 416 thus provides a visible indication of the speed of the chemical injection pump. By comparing the tachometer value and the ammeter reading from the ammeter 428, proper operation of the signal follower which controls the proportional operation of the chemical injection system can be assured. Calibration curves and charts may be posted adjacent to these instruments to provide the operator with information on the chemical composition of the product during normal operation.

The next indicator is the low air indicator 430, which is coupled to the normally closed contact of the finish mill air flow switch 136. The low air control operates a warning light 431 which indicates the possibility of fan malfunction is the normally closed contact of the flow switch 136 is opened.

A filter clog indicator 432 may also be provided and coupled to the normally opened terminal of the pressure switch 134. When the normally opened switch terminal is closed, there is indicated an excessive back pressure in the flow path 137 (see FIG. 1). Such a condition initiates a warning light 433 indicating a need to clear the ducting 137 or clean the filter apparatus 148. The pressure level setting of this control is preferably sufficiently low that no interference or misinterpretation of the flow switch signal will occur.

A ninth indicator which may be provided is the high bag bin level indicator 434. A bag bin level detector 417 may be placed at a location in the bagger bin 140 (see FIG. 1) so that if the normally opened contact of the bag bin level detector switch is closed, a warning light 435 is turned on indicating that the bin 140 is too full. The normally closed contacts of the bag bin level detector 417 are also coupled to the starter 403 so that if the bin 140 is too full, the switch 403 is turned off and the adjustable speed drive 120 and, thus, the screw feeder 122 is shut down and no additional paper is processed until the level of product in the bin 140 is reduced. At that point, the resumption of the process will begin automatically.

A thermal switch 410 may also be provided in the breaker mill fan duct 115. In operation, the normally opened contacts of the thermal switch 410 close when the temperature level exceeds the normal operating range. The normally opened contacts are coupled to a fire alarm indicator 436 which initiates a siren and flashing light 437 when the normally opened contact is closed. The siren and flashing light indicates a fire hazard or actual fire in the breaker mill paper system requiring immediate operator attention. It will be appreciated that the principal fire hazard exists in this part of the process due to the flammability of the air suspended raw ground paper leaving the breaker mill and also due to the ever-present possibility of ignition by sparks generated by foreign objects passing inadvertently into the hammermill. Permanently installed chemical injection nozzles (installed at various points in the system-not shown) and supplied with fire retardant chemical solution from the process holding tank and circulating system and controlled by solenoid valves, provide the operator with an effective fire extinguishing method.

A high paper bin level indicator 438 coupled to the normally opened terminal of a paper bin level detector 418 in the paper bin 118 (FIG. 1), which, when closed, indicate that the bin 118 is full and causing a warning light 439 to be activated. In such a situation, the normally closed contacts of the paper bin level detector 418 open automatically interrupting the operation of the raw paper feed conveyor starter 401. Thus, no additional raw paper enters the breaker mill 112 until sufficient ground paper is processed through the finish mill 126 to bring the paper bin level down to the normal operating range.

In addition to the above-described indicators, various remote control or manual switches 411, 412 and 413 may be provided to activate the raw paper feeder conveyor 108, the screw feeder 122, the chemical injection pump 192, and the solenoid valves 203 and 205 in the chemical solution pipes. Various additional controls (not shown) may also be provided, including motor starters; electrical overload protection; tank level detectors and the make-up water solenoid valves; circulating pump flow switches; pressure switches for pump protection; bag air automatic controls for feeding, packing, weighing, counting, labeling, etc.; thermostatic control for solution heating; ph controlled chemical injection in the mix tank for fine adjustment of the solution composition; flow meters for instantaneous and totalized display and control of the solution feed and preparation; pressure relief valves for maximum safe pressure limits in the system; air pressure regulators for automatic control of the air flow in various parts of this system; and magnetic and air suspension separators for removing heavy foreign matter and raw materials.

By way of illustration, the present invention may be practiced according to the following where the primary fire retardant chemical utilized was monoammonium phosphate. Of course, it will be appreciated that the present invention is not so limited and may involve other solutions and formulations of a soluble nature. Indeed, small amounts of other chemicals, such as sulfur, silicate, sulfate, borate, sodium, potassium, halogens and other ions, such as those illustrated in patent application Ser. No. 870,385, filed Jan. 18, 1978 and now abandoned, by Robert J. McCarter, can produce additional fire retardant properties with further reduction in cost. According to the illustrated example, the batch method was utilized as described in conjunction with FIG. 3 in accordance with the following formulation:

| | | |
|---|---|---|
| 1. IMC 10-50-0 Suspension Grade Agricultural Monoammonium Phosphate (MAP) (Specification sheet appended) 5 400-lb Scoops (Skip Loader) | | 2000 lb |
| 2. Tap Water at 170° F. (initially) 34 $ft^3$ (253 gal.) | | 2120 lb |
| 3. Aqua Ammonia-Technical 29% $NH_3$, 26° Baume (Specific Gravity: 0.9, Density; 7.49 lb per gal.) 30 gal. (Total); $NH_3$ (29%) = 65 lb, $H_2O$ (71%) = 160 lb | | 225 lb |
| Solution Batch Total | | 4345 lb |
| 4. Composition | | |
| MAP % | 46.0 | |
| $NH_3$ % | 1.5 | |
| $H_2O$ % | 52.5 | |
| | 100.00 | |
| 5. Trace Fungacide: Dow-cide TM (Sodium Pentachlorophenate) 197 grams = 6.94 oz. - 0.4345 lb | | 100 ppm |

Figure 5:
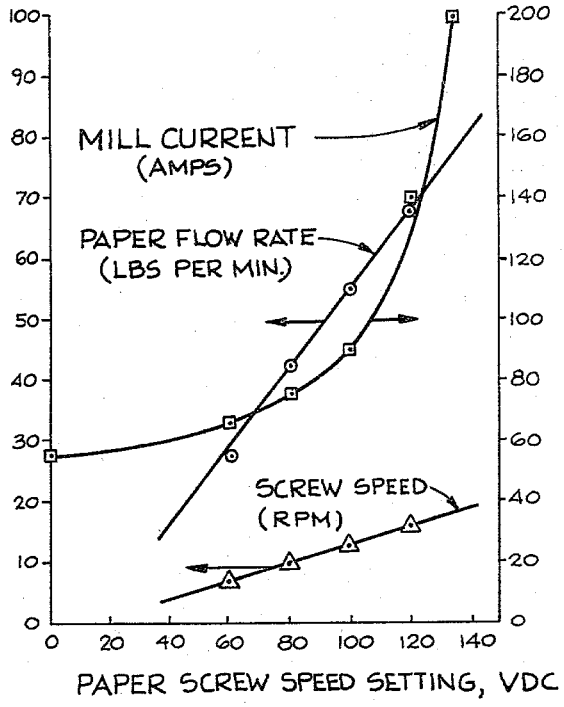
Figure 6:
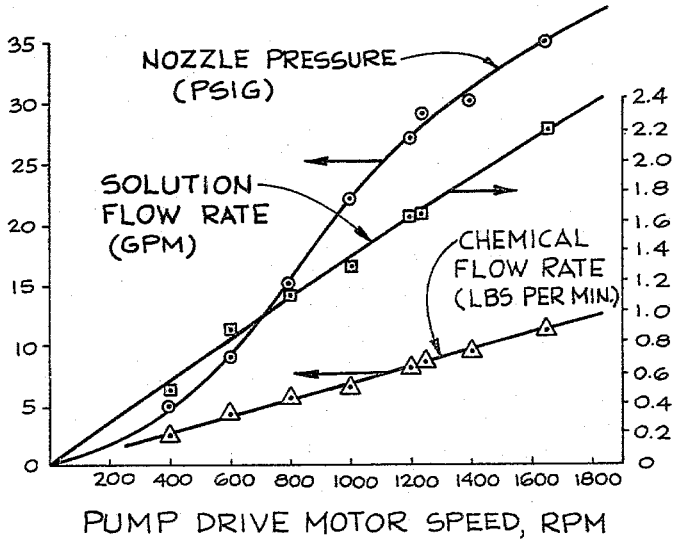

The plant, operating in the manner previously described, produces a steady output of from 2 to 3 30-lb bags per minute of finished insulation. The finish mill 126 flow characteristics are given in FIG. 5 for dry #1 newsprint broken through a 1¼ inch screen and fed to a Forster Model No. 2, Ser. No. 259-R hammermill with a 12/16" screen and direct-driven by a 125 hp G.E. 505S Frame 440/480 volt, 60 HZ., 3-phase, 2-pole, 3450 rpm motor. A 16 inch diameter paper screw feeder is driven through a 62.5 to 1 reduction by a 7.5 hp, 220 vdc shunt-wound motor. The solution injection system characteristics are given in FIG. 6 for the solution formulation given above where there was 47% solids at 130° F., 11.0 lb/gal density using a Teel Model 1P610 progressive cavity-type belt driven pump at a 3.5 to 5 reduction and powered by a Century shunt-wound dc motor rated by 1.0 hp at 1750 rpm. A typical mill operating condition is as follows:

| | |
|---|---|
| Paper Feeder Set, volts dc | 60 |
| Screw Drive Speed, rpm | 480 |
| Screw Speed, rpm | 8 |
| Finish Mill amps | 100 |
| Paper Flow, lb/min | 80 |
| Pump Speed, rpm | 770 |
| Pump Drive Speed, rpm | 1100 |
| Injector Pressure, psig | 20 |
| Solution Flow, gpm | 1.75 |

This operating condition produces a finished material having the following composition, properties and specifications as manufactured:

| | |
|---|---|
| Chemical Content (dry basis) % by Weight | 10.3 |
| Fungacide Content (dry basis) ppm | 10.3 |
| Moisture Content, % by Weight | 5.4 |
| Flame Spread Rating (ASTM E-84, 2-ft Tunnel) | |
| Conditioned Sample, Fresh | 26 |
| Aged Sample | 22 |

Since certain changes may be made in the foregoing disclosure without departing from the scope of the invention herein involved, it is intended that all matter contained in the above description and drawings be construed as illustrative and not limiting.

What is claimed is:

1. A process for continuously impregnating an initially dry first chemical agent into a quantity of fibrous, absorbant, particulate material while controlling both the amount and uniformity of the impregnation of the first chemical agent into the particulate material comprising steps of:

continuously inserting the particulate material into a stream of air flowing in a first flow path for agitating the particles of the material and transporting the particles along the first flow path;

generating a first control signal representative of the rate at which the particulate material is inserted into the first flow path;

preparing a solution of first chemical agent in a solvent;

maintaining a constant concentration of the first chemical agent in the solution;

pumping the solution through a spraying device positioned in the first flow path for moistening the particulate material moving along the first flow path; and regulating the rate of pumping the solution through the spraying device in response to the first control signal for providing a rate of flow of said solution through the spraying device in constant proportion to the rate of flow of the particulate material along the first flow path.

2. The process of claim 1 wherein the step of preparing the solution further comprises:

circulating the solvent through a bed of the first chemical agent in a container for obtaining a saturated solution of the first chemical agent in the solvent; and bleeding a fraction of the saturated solution from the container for being pumped through the spray device.

3. The process of claim 1 or 2 wherein the step of maintaining a constant concentration of the first chemical agent further comprises maintaining the solution at a constant temperature.

4. The process of claims 1 or 2 wherein at least one auxiliary liquid chemical agent is combined with the saturated solution according to the further steps of:

pumping the auxiliary chemical agent;

combining the auxiliary chemical agent with the constant concentration solution;

regulating the rate of pumping of the auxiliary chemical agent in response to the first control signal.

5. A process for controlling the quantity of a first chemical agent to be impregnated in a quantity of absorbent particulate material flowing along a first flow path comprising the steps of:

sensing the rate at which said particulate material is conveyed along said first flow path;

generating a first control signal proportional to said rate sensed;

preparing a solution having a constant concentration of the first chemical agent therein;

moving said solution along a second flow path and injecting the solution into the first flow path; and regulating the rate of movement of the solution along the second flow path in response to said first control signal for providing a rate of flow of said solution along said second flow path in constant proportion to the rate of flow of said particulate material along said first flow path.

6. The process of claim 5 wherein the step of preparing a solution further comprises:

circulating the solvent upward through a bed of the first chemical agent in a container for obtaining a saturated solution of the first chemical agent in the solvent; and bleeding a fraction of the saturated solution from the container for being pumped through the spraying device.

7. A treatment apparatus for continuously impregnating a dry particulate material with a dry chemical agent to produce a dry treated particulate material wherein the ratio of dry chemical agent to dry particulate material is substantially constant, comprising:

a passageway through which air flows;

means for injecting the particulate material into the passageway at a selected rate for being agitated and moved along the passageway by the air flowing therein, for providing a turbulent flow of particulate material along the passageway;

means for sensing the mass flow rate of the particulate material through the passageway and generating a control signal representative of the mass flow rate of the particulate material;

means for dissolving the dry chemical agent in a solvent to provide a solution of the chemical agent;

means for maintaining a constant concentration of the chemical agent in the solution;

means for pumping the solution, the pumping means coupled for being responsive to the control signal whereby the pumping rate of the pumping means is proportional to the mass flow rate of the particulate material through the passageway; and means for uniformly applying the pumped solution on the agitated particulate material flowing in the passageway for impregnating the particulate material with the chemical agent.

8. The apparatus of claim 7 wherein the means for dissolving comprises:

a container for receiving a bed of the chemical agent therein;

means for percolating the solvent upward through the bed of the chemical agent for obtaining the solution;

means for circulating the solution through the bed of the chemical agent for obtaining a solution saturated with the chemical agent; and means for maintaining the solution with the chemical agent at a constant temperature for maintaining a constant concentration of the chemical agent in the solution.

9. The apparatus of claim 7 or 8 wherein at least one auxiliary liquid chemical may be added to the solution, the apparatus further comprising:

a reservoir for containing the at least one auxiliary chemical;

a second pumping means connected for pumping the at least one auxiliary chemical from the reservoir for being combined with the solution to be applied and further coupled for being controlled by the control signal whereby the pumping rate of the second pumping means is proportional to the mass flow rate of the particulate material through the passageway.

10. The apparatus of claim 7 further comprising means for drying the solution by evaporative extraction of the solvent from the impregnated particulate material as it is air conveyed along the passageway.

11. A process of making cellulose fiber insulation comprising:

pulverizing a cellulosic material to obtain a quantity of cellulose fiberous particulate material;

agitating and conveying said particulate material along a first flow path with a turbulent stream of air;

providing a solution of a first selected chemical along a second flow path;

flowing said solution along said second path at a rate proportional to the rate at which said particulate material is conveyed along said first flow path;

injecting a stream of said solution from said second flow path into said first flow path;

injecting a jet of gas into the first flow path in a direction opposite to the direction of spraying of the stream of the solution for impinging on the stream of solution to atomize the solution and to generate a transverse region of atomized solution particles of substantially uniform density through which the agitated particulate material passes for contacting the atomized solution particles to be moistened thereby; and removing moisture from said particulate material moistened with said solution for providing a quantity of substantially dry cellulose fiber insulation impregnated with said selected chemical agent.

12. The process of claim 11 wherein the step of providing said solution comprises the substeps of:

circulating a solvent through a bed of soluble phosphate prill to obtain a saturated phosphate solution;

maintaining a constant concentration of phosphate in said saturated phosphate solution; and bleeding a fraction of said saturated phosphate solution into said second flow path to thereby provide said first selected chemical in said second flow path.

13. The process of claim 12 comprising the further substep of directly injecting at least one auxiliary chemical into said saturated solution flowing in the second flow path.

14. The process of claim 12 wherein said step of maintaining a constant concentration of phosphate in said saturated phosphate solution comprises maintaining the saturated solution at a constant temperature.

15. The process of claim 10 comprising the further steps of:

providing said stream of air along said first flow path;

injecting said fiberous particulate material into said stream of air;

drying the particulate material with said solution with the stream of air;

collecting the particulate material after it has been dried from said stream of air and placing the collected material in a bin;

exhausting the stream of air through a filter to remove residual particulate material from said stream of air; and returning said residual particulate material to said bin.

16. A process of combining a chemical solution having suspended insoluble matter therein with an agitated air-conveyed stream of fiberous particulate material comprising the steps of:

providing a flow of said solution and suspended insoluble matter along a flow path;

regulating the rate of flow of said solution having suspended insoluble matter therein along said path;

injecting a stream of said solution with insoluble suspended matter from the flow path into the air-conveyed stream of particulate material;

impinging a jet of gas on the stream of said solution having suspended insoluble matter therein for atomizing the solution and generating a transverse region of atomized solution particles of substantially uniform density through which the agitated stream of particulate material passes for contacting the particulate material; and drying the cellulose fiber so contacted.

17. A cellulose material treatment system for impregnating a cellulosic material with at least one dry chemical agent having insoluble matter therein by spraying the cellulosic material with a solution of the chemical agent where the solution contains suspended insoluble matter therein, comprising:

pulverizing means for pulverizing the cellulose material into a quantity of fibrous particulate material;

means for dissolving the protective chemical agent in a solvent to obtain a solution of the at least one chemical agent, the insoluble matter being suspended therein;

means for uniformly moistening said particulate material with said solution, said means for moistening comprising:

a first flow passageway, means for injecting a first gas into the first flow passageway for agitating the quantity of particulate material and moving said particulate material first flow passageway, a first nozzle means for injecting a stream of the solution with suspended insoluble matter therein into the agitated quantity of particulate material moving through the first flow passageway, and a second nozzle means for impinging a jet of a second gas on the stream of the solution with suspended insoluble matter therein for atomizing the solution and generating a transverse a substantially uniform density, through which the agitated particulate material passes for uniformly moistening the particulate material; and means for drying the moistened particulate material.

18. The cellulose material treatment system of claim 17 wherein said means for dissolving said at least one chemical agent in a solvent comprises:

container means for receiving a quantity of the at least one chemical agent;

counter flow percolation means for circulating solvent through the quantity of the at least one chemical agent for obtaining a saturated solution of said agent in the solvent;

control means for maintaining a constant concentration of said at least one chemical agent in said saturated solution.

19. The cellulose material treatment system of claim 18 wherein said control means comprises a temperature regulation means for sensing the temperature of the saturated solution and maintaining the saturated solution at a selected constant temperature whereby a single parameter process control is provided to maintain the constant concentration of chemical agent in solution.

20. The cellulose material treatment system of claim 17 wherein said means for drying comprises means for heating the first gas and means for maintaining the moistened particulate material in agitated suspension in the first gas until the moistened particulate material is substantially dried.

21. The cellulose treatment system of claim 20 further comprising:

container means;

means for separating said particles of dried particulate material from said first gas and depositing said quantity of treated particulate material in the container means;

means for filtering said separated first gas to separate residual particles of dried particulate material from said separated first gas; and means for transporting said residual particles to said container means.

22. A cellulose fiber insulation manufacturing system utilizing a solution containing insoluble matter in suspension therein, comprising:

means for pulverizing a cellulose material to obtain a quantity of cellulose fibers;

means defining a first flow path;

means for agitating and air-conveying said cellulose fibers along said first flow path;

means for obtaining a solution of at least one chemical agent;

means for uniformly moistening said cellulose fibers with said solution, said means for moistening comprising:

a first injection nozzle positioned in said first flow path, means for supplying said solution to said first injection nozzle for injecting a stream of said solution into the first flow path, a second injection nozzle positioned in the first flow path for supplying a jet of air to impinge the stream of the solution for atomizing the solution and generating a transverse region of atomized solution particles having a substantially uniform density through which the agitated, air conveyed, cellulose fibers pass for uniformly moistening the cellulose fibers with the solution, and means for regulating the rate at which said solution is injected into the first flow path; and means for extracting moisture from said cellulose fibers moistened with said solution for having the at least one protective chemical agent integrally with the cellulose fibers.

* * * * *

UNITED STATES PATENT AND TRADEMARK OFFICE

CERTIFICATE OF CORRECTION

PATENT NO. : 4,302,488

DATED : November 24, 1981

INVENTOR(S) : Alvin Lowi, Jr.

It is certified that error appears in the above-identified patent and that said Letters Patent are hereby corrected as shown below:

Column 8, line 33, delete "The implement" and substitute --To implement--.

Column 12, line 10, delete "is the normally" and substitute --if the normally--.

Column 14, line 3, delete "by" and substitute --at--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*